US009862011B2

(12) United States Patent
Antal et al.

(10) Patent No.: US 9,862,011 B2
(45) Date of Patent: Jan. 9, 2018

(54) TUBE CLEANING DART HAVING BLADES

(71) Applicant: National Heat Exchange Cleaning Corporation, Youngstown, OH (US)

(72) Inventors: Brian D. Antal, Fombell, PA (US); Carroll E. Joseph, Leetonia, OH (US)

(73) Assignee: National Heat Exchange Cleaning Corporation, Youngstown, OH (US)

( * ) Notice: Subject to any disclaimer, the term of this patent is extended or adjusted under 35 U.S.C. 154(b) by 268 days.

(21) Appl. No.: 14/613,611

(22) Filed: Feb. 4, 2015

(65) Prior Publication Data

US 2016/0221052 A1 Aug. 4, 2016

(51) Int. Cl.
*B08B 9/055* (2006.01)
*F28G 1/12* (2006.01)

(52) U.S. Cl.
CPC ..... *B08B 9/0553* (2013.01); *B08B 9/0557* (2013.01); *F28G 1/12* (2013.01)

(58) Field of Classification Search
CPC ..... B08B 9/0553; B08B 9/0557; F28G 1/12
See application file for complete search history.

(56) References Cited

U.S. PATENT DOCUMENTS

| | | | | |
|---|---|---|---|---|
| 2,201,680 | A * | 5/1940 | Haynes | B08B 9/0553 15/104.061 |
| 4,920,600 | A | 5/1990 | Reinhart | |
| 5,153,963 | A | 10/1992 | Saxon et al. | |
| 6,085,376 | A * | 7/2000 | Antal | B08B 9/0557 15/104.061 |
| 2010/0294316 | A1 * | 11/2010 | Antal | B08B 9/0436 134/22.12 |
| 2012/0042461 | A1 | 2/2012 | Antal et al. | |

* cited by examiner

*Primary Examiner* — Randall Chin
(74) *Attorney, Agent, or Firm* — The Webb Law Firm

(57) ABSTRACT

A dart assembly for cleaning tubes including at least one annular disk having a first end, a second end, an outer perimeter and at least one longitudinal groove in the outer perimeter extending from the first end to the second end and at least one cutting wheel. The cutting wheel is positioned within the groove such that a portion of the cutting wheel extends into the groove and a portion extends beyond the outer perimeter of the annular disk. The dart assembly may also include at least one scraper disk and the annular disk and the scraper disk may be positioned at opposite ends of a shaft. Also, a method of cleaning a tube where a dart assembly is inserted into the inner diameter of the tube and forced through the tube using pressurized fluid. The dart assembly may have any or all of the features described above.

17 Claims, 4 Drawing Sheets

TUBE CLEANING DART HAVING BLADES

BACKGROUND OF THE INVENTION

Field of the Invention

The present invention relates to a tube cleaning apparatus and a method of cleaning a tube using the tube cleaning apparatus, more particularly, to a dart assembly having blades used to clean heat exchanger and condenser tubing or piping and a method of cleaning heat exchanger and condenser tubing or piping using the dart assembly.

Description of Related Art

Many heat exchangers utilize water or other liquids passing through tubes. Water sources passing through the tubes present many problems, such as deposits and obstructions that limit the heat transfer and life expectancy of the tubing. Slime, sticks, mud, shells, calcium carbonate scale, and manganese scale are just some examples of materials that can deposit in or obstruct heat exchanger tubes.

Tube cleaning assemblies have been developed to aid in the removal of the obstructions and deposits. Typically, these tube cleaning assemblies include a fin or blade arrangement attached to a body. The tube cleaning assembly is placed at one end of the tube to be cleaned with the fins in contact with an inner surface of the tube. High pressure water is forced through the tube and pushes the tube cleaning assembly through the tube, scraping the inner surface and removing obstructions and deposits along the way until the tube cleaning assembly exits the tube.

U.S. Pat. No. 5,153,963 to Saxon et al. describes one such tube cleaning assembly. The assembly has a cylindrical body having an outer diameter that is less than the inner diameter of said tube to be cleaned. The cylindrical body includes a nose portion on one end and a tail portion on the other end. A plurality of spaced freewheeling cutting wheels is provided in and extends radially outwardly from the cylindrical body. The cutting wheels are at least partially contained within the confines of the cylindrical body. The cutting wheels act to break up mineral scale deposits in the interior of the pipe as the assembly is forced through the tube.

These scraper-type assemblies can be very efficient at removing certain types of deposits and obstructions. However, the deposits and obstructions in the tube can vary and can include a mixture of different types of deposits and obstructions. It is therefore desirable to have a tube cleaning assembly that includes more than one means for cleaning the tube and includes means for debris to be removed from the tube cleaning assembly.

SUMMARY OF THE INVENTION

The present invention is directed to a dart assembly for cleaning tubes. The dart assembly includes at least one annular disk having a first end, a second end, an outer perimeter, at least one longitudinal groove in the outer perimeter extending from the first end to the second end, and at least one cutting wheel. The cutting wheel is positioned within the longitudinal groove such that a portion of the cutting wheel extends into the longitudinal groove and a portion of the cutting wheel extends beyond the outer perimeter of the annular disk. The annular disk may have a central through-hole, and the dart assembly may include a shaft that passes through the central through-hole of the annular disk. The dart assembly may also include at least one scraper disk. The annular disk may be positioned at a first end of the shaft, and the scraper disk may be positioned at a second end of the shaft. A spacer that surrounds the shaft may be positioned between the annular disk and the scraper disk.

The central axis of rotation of the cutting wheel may be transverse to the longitudinal axis of the annular disk, and the cutting wheel may be attached to the annular disk by a mounting ring which passes through a central through-hole in the cutting wheel.

The annular disk may have a circumferential groove in its outer perimeter, and the mounting ring may be fitted in the circumferential groove such that a portion of the cutting wheel extends into the longitudinal groove and a portion of the cutting wheel extends beyond the outer perimeter of the annular disk.

The dart assembly may include more than one cutting wheel, longitudinal grooves, scrapers, annular disks, and/or mounting rings. A plurality of cutting wheels may be positioned within a plurality of first longitudinal grooves, and the annular ring may also include a plurality of second longitudinal grooves such that each second longitudinal groove is located between two first longitudinal grooves in an alternating manner. The plurality of first longitudinal grooves may extend further into the outer perimeter of the annular disk than the plurality of second longitudinal grooves.

The present invention is also directed to a method of cleaning a tube. A dart assembly is inserted into the inner diameter of the tube and forced through the tube using pressurized fluid. The dart assembly may have any or all of the features described above. The pressurized fluid may be provided at a pressure of 100 to 450 psi. The first end of the shaft may be inserted into the tube first such that the interior surface of the tube is first contacted by the cutting wheel and then contacted by the scraper disk as the dart assembly is forced through the tube.

BRIEF DESCRIPTION OF THE DRAWING(S)

DESCRIPTION OF THE INVENTION

Figure 1:
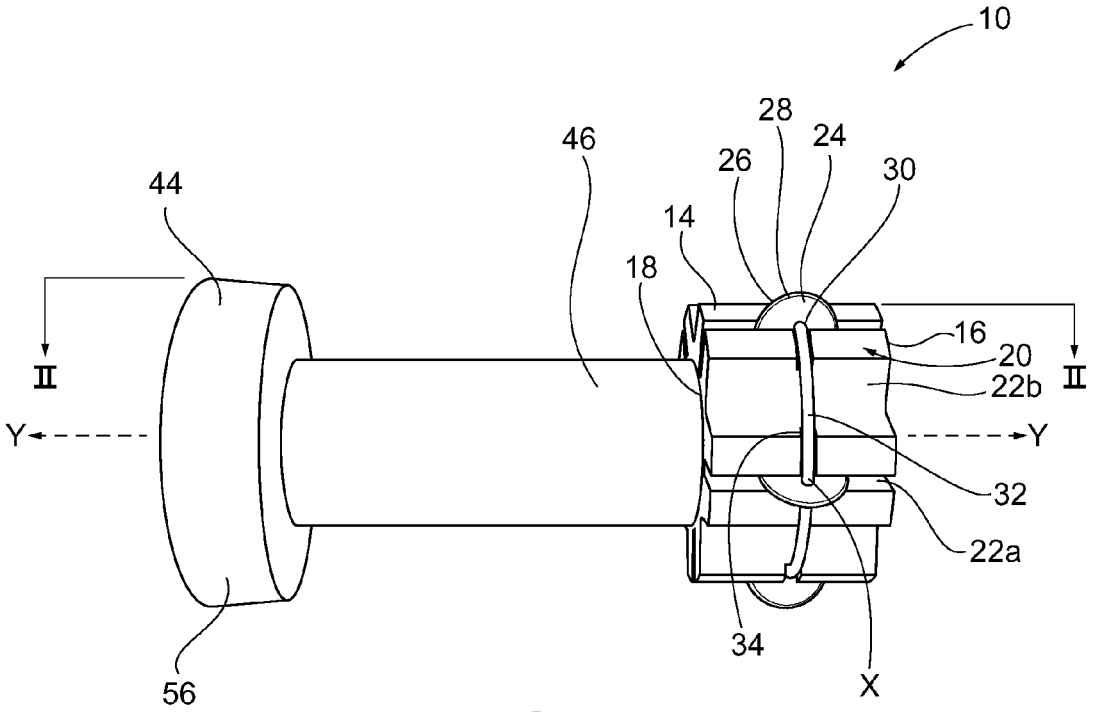
FIG. 1 is a side elevational view of a dart assembly according to the present invention.
Figure 2:
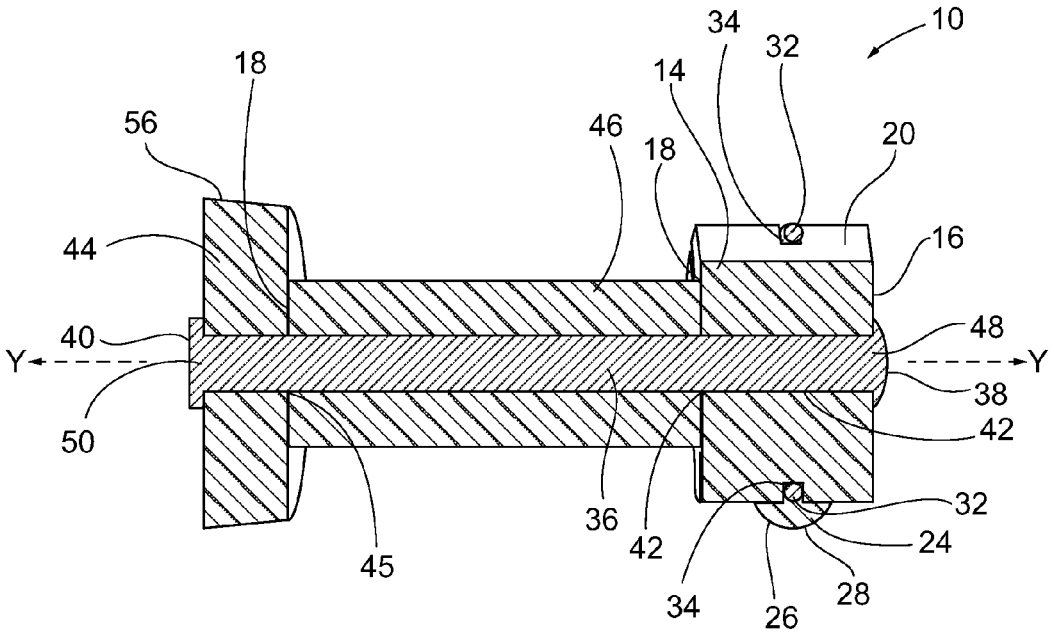
FIG. 2 is a cross-sectional view taken along line II-II of the dart assembly of FIG. 1.
Figure 3:
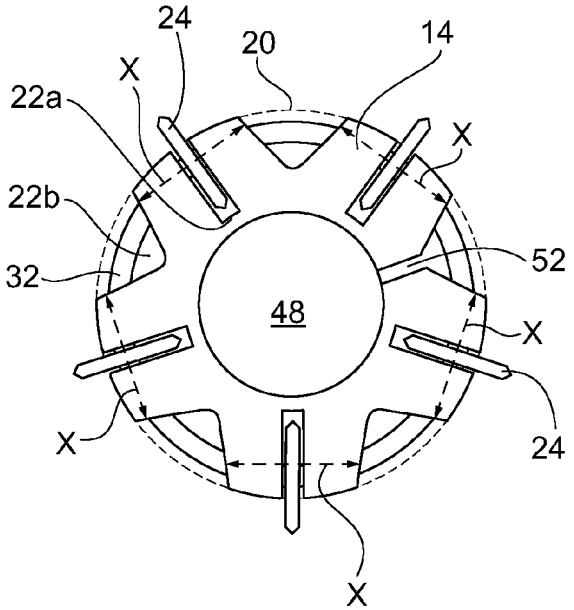
FIG. 3 is an elevational view of the first end of the dart assembly of FIG. 1.
Figure 4:
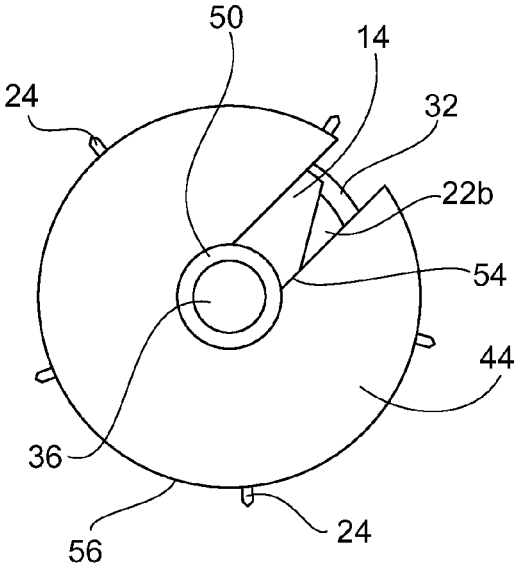
FIG. 4 is an elevational view of the second end of the dart assembly of FIG. 1.

The present invention is directed to a dart assembly 10, 100 for cleaning a tube 12 such as a heat exchanger tube. The dart assembly 10, 100 is inserted in the tube 12 to be cleaned and pushed through the tube 12 using a pressurized fluid such as water or air.

The dart assembly includes at least one annular disk 14 having a first end 16, a second end 18, an outer perimeter 20, and at least one longitudinal groove 22*a*, 22*b* in the outer perimeter 20 extending from the first end 16 to the second end 18. While the annular disk 14 includes at least one longitudinal groove 22*a*, 22*b*, it may include a plurality of longitudinal grooves 22*a*, 22*b*. The longitudinal grooves 22*a*, 22*b* may all extend for the same depth from the outer perimeter 20 of the annular disk 14 into the body of the annular disk 14, or may extend for different depths from the outer perimeter 20 of the annular disk 14 into the body of the annular disk 14 and may have circumferential widths that are the same or different. For example, as shown in FIGS. 1-8, the annular disk 14 may include a plurality (five) of first longitudinal grooves 22*a* extending a first depth from the outer perimeter 20 of the annular disk 14 into the body of the annular disk 14 and having a first circumferential width and a plurality (five) of second longitudinal grooves 22*b* extending a second depth from the outer perimeter 20 of the annular disk 14 into the body of the annular disk 14 and having a second circumferential width. In this case, the first distance is longer than the second distance and the first circumferential width is smaller than the second circumferential width such that the plurality of first longitudinal grooves 22*a* is deeper and narrower than the plurality of second longitudinal grooves 22*b*. In addition, each first longitudinal groove 22*a* is located between two second longitudinal grooves 22*b*, and each second longitudinal groove 22*a* is located between two first longitudinal grooves, such that the first longitudinal grooves 22*a* and the second longitudinal grooves 22*b* are arranged in an alternating fashion. However, longitudinal grooves of varying depths and widths may be placed in any arrangement around the outer perimeter 20 of the annular disk 14 as long as they provide channels through which fluid can flow as the dart assembly 10, 100 passes through the tube 12.

The cross-section of the longitudinal grooves 22*a*, 22*b* may take any suitable shape including, but not limited to, curved, U-shaped, V-shaped, and semi-circular.

The annular disk 14 may be made of any suitable material including, but not limited to, high density polyethylene.

At least one cutting wheel 24 is disposed within at least one longitudinal groove 22*a*, 22*b* of the annular ring 14. The cutting wheel 24 is generally circular and includes a cutting edge 26 around its outer perimeter 28. The cutting edge 26 may be a beveled edge that comes to a point. The cutting wheel 24 may be made of any material suitable for cutting into and breaking up mineral deposits on the inside of the tube 12. Such materials include, but are not limited to, metals including carbide and stainless steel. While the dart assembly 10, 100 includes at least one cutting wheel 24 it may include a plurality of cutting wheels 24. For example, as shown in FIGS. 1-8, the dart assembly 10, 100 includes a plurality (five) of cutting wheels 24.

The cutting wheels 24 are disposed within the longitudinal grooves 22*a*, 22*b* of the annular disk 14 such that a portion of the cutting wheel 24 is disposed within the longitudinal groove 22*a*, 22*b* and a portion of the cutting wheel 24 extends beyond the outer perimeter 20 of the annular disk 14.

The cutting wheels 24 may be attached to the annular disk 14 in any suitable manner as long as they can rotate around a central axis of rotation X that is transverse to the central axis Y of the annular disk 14. For example, as shown in FIGS. 1-8, each of a plurality of cutting wheels 24 is provided with a central through-hole 30. A mounting ring 32 passes through the central through-hole 30 of each cutting wheel 24. The annular disk 14 has a circumferential groove 34 in its outer perimeter 20 and the mounting ring 32 is fitted in the circumferential groove 34 such that a portion of each cutting wheel 24 extends into one of the longitudinal grooves 22*a*, 22*b* of the annular disk 14 and a portion of each cutting wheel 24 extends beyond the outer perimeter 20 of the annular disk 14. In this embodiment, the plurality of cutting wheels 24 is equally spaced around the mounting ring 32 and the annular disk 14 although the cutting wheels 24 may be placed in any arrangement around the mounting ring 32 and the annular disk 14.

In the embodiment shown in FIGS. 1-8, the plurality (five) of cutting wheels 24 is disposed in the deeper, narrower first longitudinal grooves 22*a*. However, it should be understood that the arrangement of the cutting wheels 24 in the longitudinal grooves may vary and that any number of cutting wheels 24 may be placed in longitudinal grooves 22*a*, 22*b* having any combination of depths and widths.

The sizing of the annular disk 14 and the placement of the cutting wheels 24 with respect to the outer perimeter 20 of the annular disk 14 is set such that the outer circumferential perimeter of the dart assembly as defined by the outermost extending portions of the cutting wheels will have a diameter that allows the cutting wheels 24 to contact the debris on the inner diameter of the tube 12 but does not exceed the inner diameter of the tube 12.

The dart assembly 10, 100 may include a shaft 36 having a first end 38 and a second end 40. The shaft 36 may pass through a central through-hole 42 in the annular disk 14 such that the annular disk 14 is disposed at the first end 38 of the shaft 36. At least one scraper disk 44 may also be provided at the second end 40 of the shaft 36. The scraper disk 44 has a generally circular shape and a diameter that is 0.002-0.004 inches smaller than the inner diameter of the tube 12. The shaft 36 may pass through a central through-hole 45 in the scraper disk 44.

The scraper disk 44 may be made of any suitable material including, but not limited to, high density polyethylene.

The annular disk 14 and the scraper disk 44 may be held on the shaft 36 in any suitable manner including, but not limited to, end flanges, and adhesive. In the embodiments, shown in FIGS. 1, 2, and 5, a spacer 46 having a generally cylindrical shape surrounds the shaft 36 between the annular disk 14 and the scraper disk 44 to hold them at a fixed distance from one another. The annular disk 14, the scraper disk 44, and/or the spacer 46 are held in place on the shaft by a flange 48 on the first end 38 of the shaft 36 and a crimped end 50 on the second end 40 of the shaft 36. However, other suitable means including but not limited to, threaded ends on the shaft with nuts or washers may be used.

The spacer 46 may be made of any suitable material including, but not limited to, polypropylene.

Figure 6:
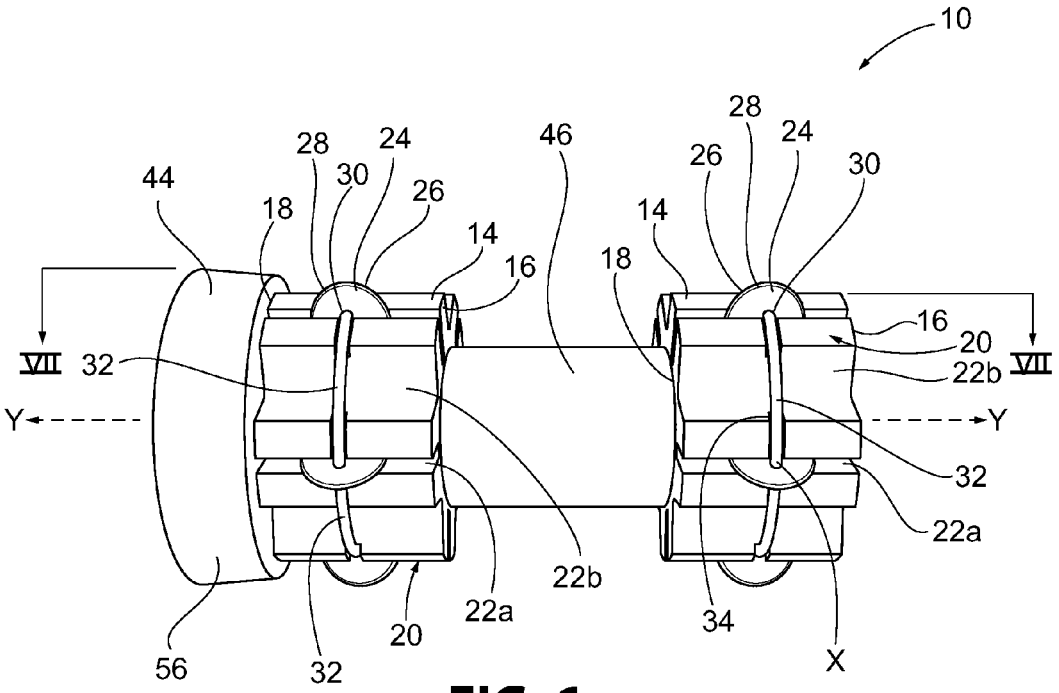
FIG. 6 is a side elevational view of another dart assembly according to the present invention.
Figure 7:
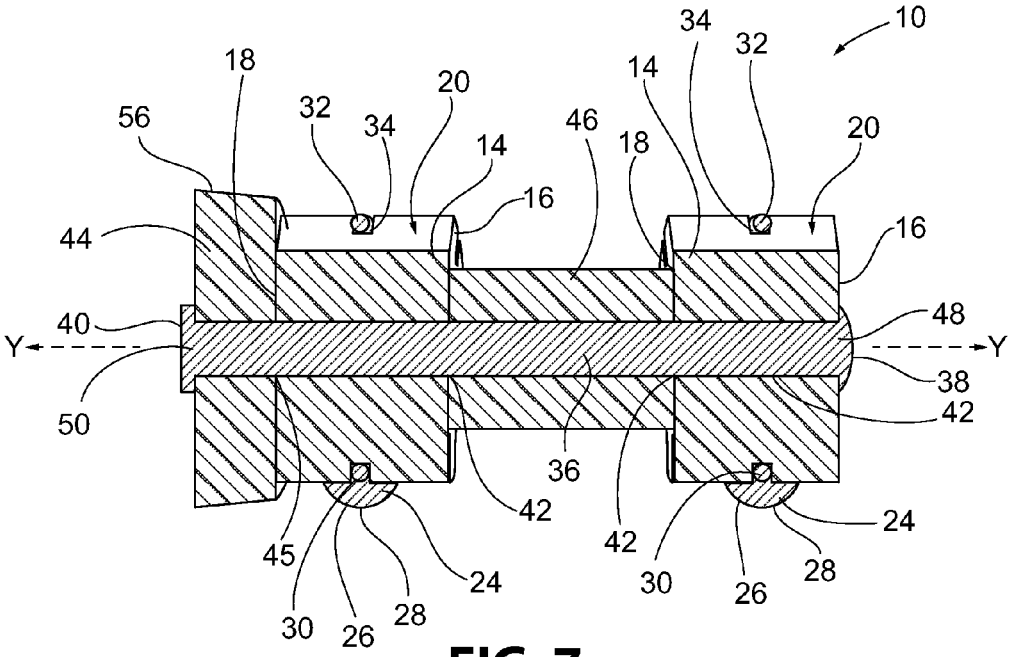
FIG. 7 is a cross-sectional view taken along the line VII-VII of the dart assembly of FIG. 6.
Figure 8:
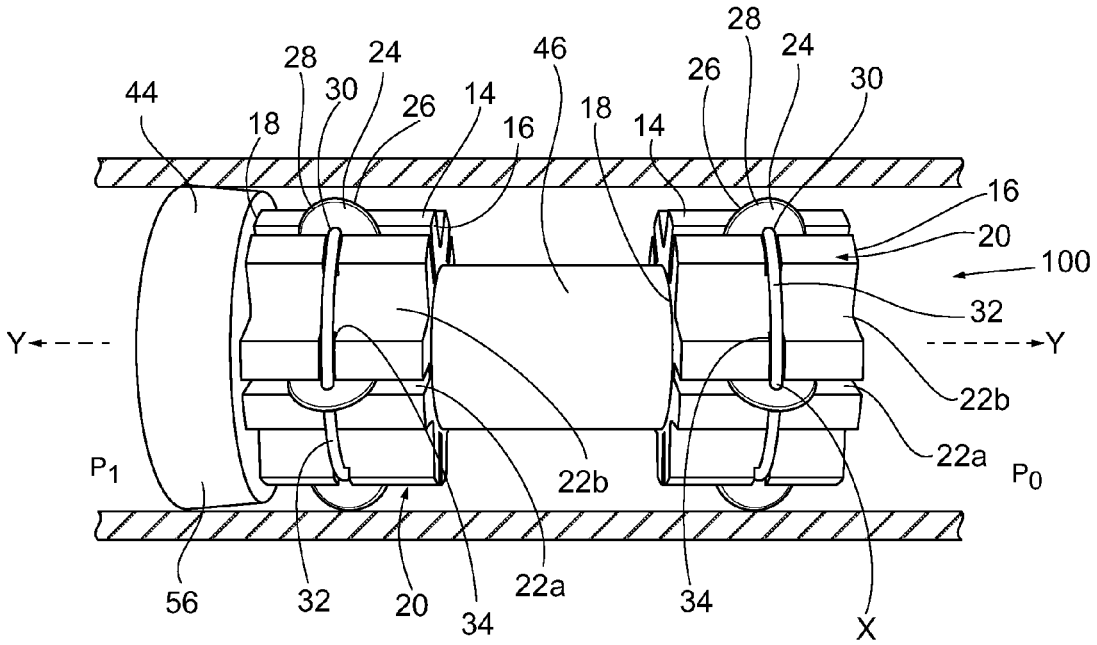
FIG. 8 is a side elevational view, partially in section, of the dart assembly of FIG. 6 inserted into a tube.

As shown in FIGS. 6-8, the dart assembly 100 may include two annular disks 14 with the associated mounting rings 32 and cutting wheels 24 placed on the shaft 36 with the first annular disk 14 disposed near the first end 38 of the shaft 36 and the second annular disk 14 disposed near the second end 40 of the shaft 36 just above the scraper disk 44. If the assembly configuration using the spacer 46 described above is used, the spacer 46 is placed between the two annular disks 14 as shown in FIGS. 6-8.

The dart assembly 10, 100 can be assembled by threading the annular disk 14, the spacer 46, the optional second annular disk 14, and the scraper disk 44 onto a shaft 36 having a flange 48 on the first end 38. The second end 40 of the shaft 36 is then crimped to hold the annular disk 14, the spacer 46, the optional second annular disk 14, and the scraper disk 44 on the shaft 36.

Alternatively, the annular disk 14 and/or the scraper disk 44 may include a slit 52, 54 (shown in FIG. 4) extending from their outer perimeters 20, 56, respectively, to their central through-holes 42, 45, respectively, to allow them to slide onto and around the shaft 36 without having to be threaded onto an end of the shaft 36. This allows the ends of the shaft 36 (flange 48 and crimped end 50) to be fabricated before the annular disk 14, the scraper disk 44, and/or the spacer 46 are placed on the shaft 36. In this manner, a shaft 36 having a flange 48 at its first end and a crimped end 50 at its second end can be placed into the slit 52 in the first annular disk 14, advanced into the central through-hole 42 of the annular disk 14, and held there by the placement of the mounting ring 32. The spacer 46 can then be threaded onto the shaft 36, and the shaft 36 can be placed into the slits 52, 54 in the optional second annular disk/mounting ring 14, 32 and the scraper disk 44 advanced into the central through-hole 42 of the optional second annular disk 14 and the scraper disk 44. These slits 52, 54 also allow fluid to pass through the annular disk 14 and/or the scraper disk 44 during cleaning of the tube.

Figure 5:
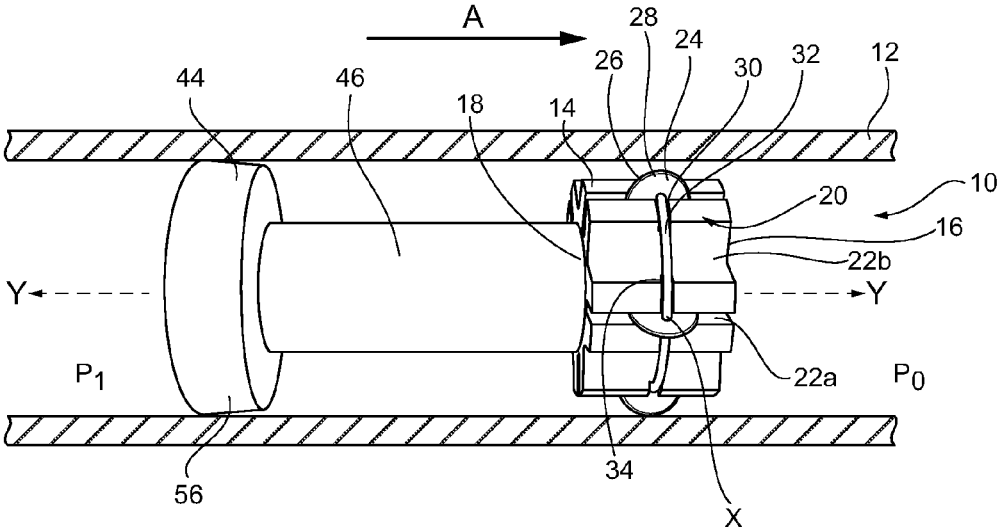
FIG. 5 is a side elevational view, partially in section, of the dart assembly of FIG. 1 inserted into a tube.

As shown in FIGS. 5 and 8, in use, the dart assembly 10, 100 is inserted into the tube 12 that is to be cleaned with the annular disk 14 being inserted into the tube 12 first. A fluid, such as water or air, at a pressure $P_1$, which is higher than the existing pressure $P_0$ inside of the tube 12, is then supplied to the tube 12 such that it impinges the scraper disk 44. The direction of the fluid flow is shown by the arrows A in FIGS. 5 and 8. The pressurized fluid may be at a pressure of 100 to 450 psi. The fluid pressure forces the dart assembly 10, 100 through the tube 12 toward the exit end with a portion of fluid passing through the longitudinal grooves 22*a*, 22*b* on the annular disk(s) 14. The cutting wheels 24 cut into and break up deposits on the inner surface of the tube 12 which are then pushed along and further removed by the scraper disk 44 or are carried by the fluid. The fluid flows through the longitudinal grooves 22*a*, 22*b* on the annular disk 14 and aids in removing any deposits that attach to the dart assembly 10, 100 especially any deposits which might block rotation of the cutting wheels 24 or blunt their cutting edges 26. After the dart assembly 10, 100 exits the tube 12, the process can be repeated on another tube 12.

Although the invention has been described in detail for the purpose of illustration based on what is currently considered to be the most practical and preferred embodiments, it is to be understood that such detail is solely for that purpose and that the invention is not limited to the disclosed embodiments but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A dart assembly for cleaning tubes comprising:

at least one annular disk having a first end, a second end, an outer perimeter, at least one longitudinal groove in the outer perimeter extending from the first end to the second end, and a circumferential groove in the outer perimeter;

at least one cutting wheel positioned within the at least one longitudinal groove; and a mounting ring which passes through a central through-hole of the at least one cutting wheel and is fitted in the circumferential groove.

2. The dart assembly of claim 1, wherein a portion of the at least one cutting wheel extends into the at least one longitudinal groove and a portion of the at least one cutting wheel extends beyond the outer perimeter of the at least one annular disk.

3. The dart assembly of claim 1 further comprising:

a central through-hole in the at least one annular disk, and a shaft having a first end and a second end, wherein the shaft passes through the central through-hole of the at least one annular disk.

4. The dart assembly of claim 3 further comprising at least one scraper disk, wherein the at least one annular disk is positioned at the first end of the shaft and the at least one scraper disk is positioned at the second end of the shaft.

5. The dart assembly of claim 4 further comprising a spacer surrounding the shaft and positioned between the at least one annular disk and the at least one scraper disk.

6. The dart assembly of claim 3, wherein a central axis of rotation of the at least one cutting wheel is transverse to a longitudinal axis of the annular disk.

7. The dart assembly of claim 1 comprising a plurality of cutting wheels positioned within a plurality of first longitudinal grooves.

8. The dart assembly of claim 7 wherein the at least one annular disk comprises a plurality of second longitudinal grooves such that each second longitudinal groove is located between two first longitudinal grooves in an alternating manner.

9. The dart assembly of claim 8 wherein the plurality of first longitudinal grooves extends further into the outer perimeter of the at least one annular disk than the plurality of second longitudinal grooves.

10. A method of cleaning a tube comprising:

inserting a dart assembly into the inner diameter of the tube; and forcing the dart assembly through the tube using pressurized fluid, wherein the dart assembly comprises:

at least one annular disk having a first end, a second end, an outer perimeter, at least one longitudinal groove in the outer perimeter extending from the first end to the second end, and a circumferential groove in the outer perimeter;

at least one cutting wheel positioned within the at least one longitudinal groove; and a mounting ring which passes through a central through-hole of the at least one cutting wheel and is fitted in the circumferential groove.

11. The method of claim 10, wherein pressurized fluid at a pressure of 100 to 450 psi is used to force the dart assembly through the tube.

12. The method of claim 10, wherein a portion of the at least one cutting wheel extends into the at least one longitudinal groove and a portion of the at least one cutting wheel extends beyond the outer perimeter of the at least one annular disk.

13. The method of claim 10, wherein the dart assembly further comprises a shaft having a first end and a second end and at least one scraper disk wherein the at least one annular disk and the at least one cutting wheel are disposed at the first end of the shaft and the at least one scraper disk is disposed at the second end of the shaft.

14. The method of claim 13, wherein a first end of the shaft is inserted into the tube first such that the interior surface of the tube is first contacted by the at least one cutting wheel and then contacted by at least one scraper disk as the dart assembly is forced through the tube.

15. The method of claim 10, wherein the dart assembly comprises a plurality of cutting wheels disposed within a plurality of first longitudinal grooves.

16. The method of claim 15, wherein the at least one annular disk comprises a plurality of second longitudinal grooves such that each second longitudinal groove is located between two first longitudinal grooves in an alternating manner.

17. The method of claim 15, wherein the plurality of first longitudinal grooves extends further into the outer perimeter of the at least one annular disk than the plurality of second longitudinal grooves.

* * * * *